US010286252B2

(12) United States Patent
Hsu

(10) Patent No.: US 10,286,252 B2
(45) Date of Patent: May 14, 2019

(54) RHYTHM FITNESS STEP APPARATUS

(71) Applicant: CHIA LIN SPORT CO.,LTD., Hemei Township, Changhua County (TW)

(72) Inventor: Chih-Yu Hsu, Hemei Township, Changhua County (TW)

(73) Assignee: CHIA LIN SPORT CO., LTD., Changhua County (TW)

( * ) Notice: Subject to any disclaimer, the term of this patent is extended or adjusted under 35 U.S.C. 154(b) by 39 days.

(21) Appl. No.: 15/607,646

(22) Filed: May 29, 2017

(65) Prior Publication Data

US 2018/0339191 A1 Nov. 29, 2018

(51) Int. Cl.

| | |
|---|---|
| ***A63B 23/00*** | (2006.01) |
| ***A63B 22/16*** | (2006.01) |
| ***A63B 23/04*** | (2006.01) |
| ***A63B 22/04*** | (2006.01) |
| *A63B 22/00* | (2006.01) |

(52) U.S. Cl.

CPC ..... *A63B 22/16* (2013.01); *A63B 22/04* (2013.01); *A63B 23/04* (2013.01); *A63B 23/0458* (2013.01); *A63B 2022/0038* (2013.01)

(58) Field of Classification Search

None

See application file for complete search history.

(56) References Cited

U.S. PATENT DOCUMENTS 5,050,861 A * 9/1991 Thomas ..... A63B 23/0458 108/107
5,096,186 A * 3/1992 Wilkinson ..... A63B 23/0458 108/12
5,108,089 A * 4/1992 Wilkinson ..... A63B 23/0458 108/12
5,118,095 A * 6/1992 Flor ..... A63B 23/0458 182/46
5,154,678 A * 10/1992 Adamczyk ..... A63B 23/0458 108/90
5,169,360 A * 12/1992 Saunders ..... A63B 23/0458 108/12

(Continued)

*Primary Examiner* — Stephen R Crow

(57) ABSTRACT

A rhythm fitness step apparatus includes a body and two leg bases. The body has an upper surface and a lower surface, wherein the upper surface is installed with a platform thereon; both sides of the lower surface are formed with an installation space separately. The installation space has a plurality of slots and a plurality of dodge slots concavely and alternately installed therein, wherein the concave depth of the slot and the concave depth of the dodge slot are different so that the depth of the dodge slot is greater than the depth of the slot in design. The leg base has a plate body. The lower surface of the plate body is installed with a cushion pad; the upper surface of the plate body has a plurality of first supporting blocks and a plurality of second supporting blocks protruding therefrom alternately and corresponding to the configuration layout of the slots and the dodge slots of the body. The distance of the second supporting block protruding from the upper surface of the plate body is larger than that of the first supporting block protruding from the upper surface of the plate body so that the setting between every first supporting block and every second supporting block is in the form of a stair shape with a difference in height.

8 Claims, 8 Drawing Sheets

(56) References Cited

U.S. PATENT DOCUMENTS

| | | | | | |
|---|---|---|---|---|---|
| 5,248,286 | A * | 9/1993 | Wilkinson | A47C 3/20 | 108/12 |
| 5,275,579 | A * | 1/1994 | Wilkinson | A47C 3/20 | 248/157 |
| 5,591,105 | A * | 1/1997 | Dalebout | A63B 23/0458 | 248/188.2 |
| 5,772,559 | A * | 6/1998 | Sithole | A63B 23/0458 | 482/51 |
| 2005/0101444 | A1* | 5/2005 | Dadbeh | A63B 21/00047 | 482/52 |
| 2006/0040796 | A1* | 2/2006 | Holloway | A63B 21/028 | 482/52 |
| 2006/0189448 | A1* | 8/2006 | Flentye | A63B 23/0458 | 482/52 |
| 2006/0189449 | A1* | 8/2006 | Flentye | A63B 23/0458 | 482/52 |
| 2012/0202652 | A1* | 8/2012 | Ross | A63B 23/0458 | 482/52 |
| 2014/0066262 | A1* | 3/2014 | Kennedy | A63B 71/0036 | 482/52 |
| 2015/0196799 | A1* | 7/2015 | Chua | A63B 23/1236 | 482/141 |
| 2017/0080284 | A1* | 3/2017 | Hillson | A63B 23/0458 | |

* cited by examiner

RHYTHM FITNESS STEP APPARATUS

BACKGROUND

The present invention relates to a rhythm fitness step apparatus for both legs to lift and step on alternately.

DESCRIPTION OF THE PRIOR ART

Currently, most of the rhythm fitness steps of the prior art generally include a rectangular-shaped body with a non-slip pattern on the surface of the body. One preferred method of using the rhythm fitness step is to place the body thereof on the floor to allow the user's both legs alternately to lift and step on the body of the fitness step.

However, the aforementioned structure of the prior art has the following problems in practical implementation: (1) the rhythm fitness step can only provide a fixed height for step workout wherein the design thereof, unable to provide different levels of strength training, is lack of the better health effect of exercise; (2) the rhythm fitness step can only provide a fixed height for step workout and users, who step up and down repeatedly on the rhythm fitness step of one same height, may easily feel dull, bored, and tired of the rhythm fitness step eventually; (3) the rhythm fitness step usually has a plate body of hard materials that easily generates irritating noise while making direct contact with the floor.

Therefore, in view of the aforementioned problems, authors of the present invention designed an apparatus based on years of experience and knowledge, investigated its implementation thoroughly, and produced a prototype for testing. After revising and improving the design for several times, the present invention is disclosed.

SUMMARY

Technical problems intended to be solved are:

The exercise process using the rhythm fitness step of the prior art can be quite boring and can not provide much higher levels of strength training in exercise. These are the problems to be solved.

The technical characteristics used to solve the problems are:

A rhythm fitness step apparatus of the present invention includes a body and two leg bases. The body has an upper surface and a lower surface, wherein the upper surface is installed with a platform thereon. The body can be placed on the floor directly and, by means of the platform on the upper surface, allow users to lift both legs and step on it alternately. In this mode of exercise, the body is used as a step on platform of low level in height. Furthermore, both sides of the lower surface of the body are formed with an installation space separately. The installation space has a plurality of slots and a plurality of dodge slots concavely and alternately installed therein, wherein the concave depth of the slot and the concave depth of the dodge slot are different so that the depth of the dodge slot is larger than the depth of the slot in design. The leg base has a plate body. The lower surface of the plate body is installed with a cushion pad; the upper surface of the plate body has a plurality of first supporting blocks and a plurality of second supporting blocks protruding therefrom alternately and corresponding to the configuration layout of the slots and the dodge slots of the body. The distance of the second supporting block protruding from the upper surface of the plate body is larger than that of the first supporting block protruding from the upper surface of the plate body so that the setting between every first supporting block and every second supporting block is in the form of a stair shape with a difference in height. By selecting supporting blocks of different protruding heights between the first supporting blocks and the second supporting blocks to be plugged into the slots of the body, the body of the rhythm fitness step apparatus can achieve different heights in structure, in terms of creating differences between the medium level of strength training and the high level of strength training. The outer upper edges of every first supporting block and every second supporting block have a soft pad mounted thereon, therefore, hereby to form a rhythm fitness step apparatus.

The effectiveness of the present invention, in comparison with that of apparatus the prior art, has many folds:

(1) The rhythm fitness step apparatus of the present invention has a suitable size and a simple structure and, therefore, is feasible for regular households to purchase for achieving the effect of exercise within an indoor space.

(2) The rhythm fitness step apparatus of the present invention can be used for exercise for different parts of the user's body. Furthermore, the methods of fitness exercise of the present invention are not limited to simple movements of the low level of strength training. Instead, the present invention provides methods of fitness exercise involving movements of the basic level to the advanced level and rhythmic to aerobic exercises. Therefore, the rhythm fitness step apparatus of the present invention increases the practicality significantly and avoids the same repeated exercise method that may cause users to feel bored and dull.

(3) The rhythm fitness step apparatus of the present invention is designed to separate the leg base and the floor, as well as the body and the leg base, by using the cushion pads and soft pads. Therefore, the design of the present invention can prevent the direct impact between hard objects that generates irritating noise. Using the cushion pads and soft pads to reduce the vibration during exercise can also effectively prolong the service life of the rhythm fitness step apparatus and better prevent sports injuries from happening.

BRIEF DESCRIPTION OF THE DRAWINGS

The present invention will become more fully understood from the detailed description given herein below for illustration only which thus does not limit the present invention, wherein.

DETAILED DESCRIPTION OF PREFERRED EMBODIMENT

Figure 1:
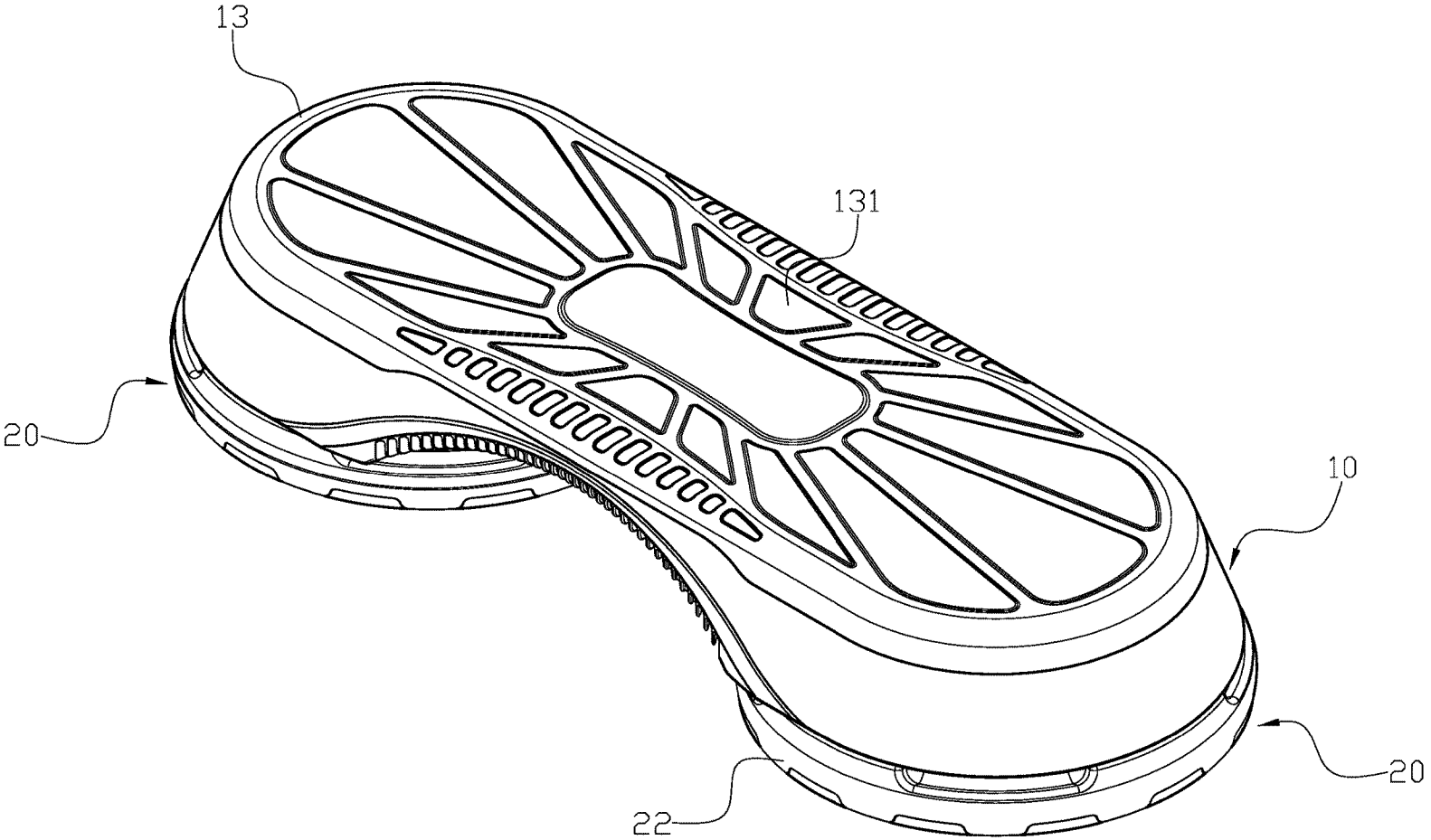
FIG. 1 is a three dimensional schematic diagram of the present invention.
Figure 2:
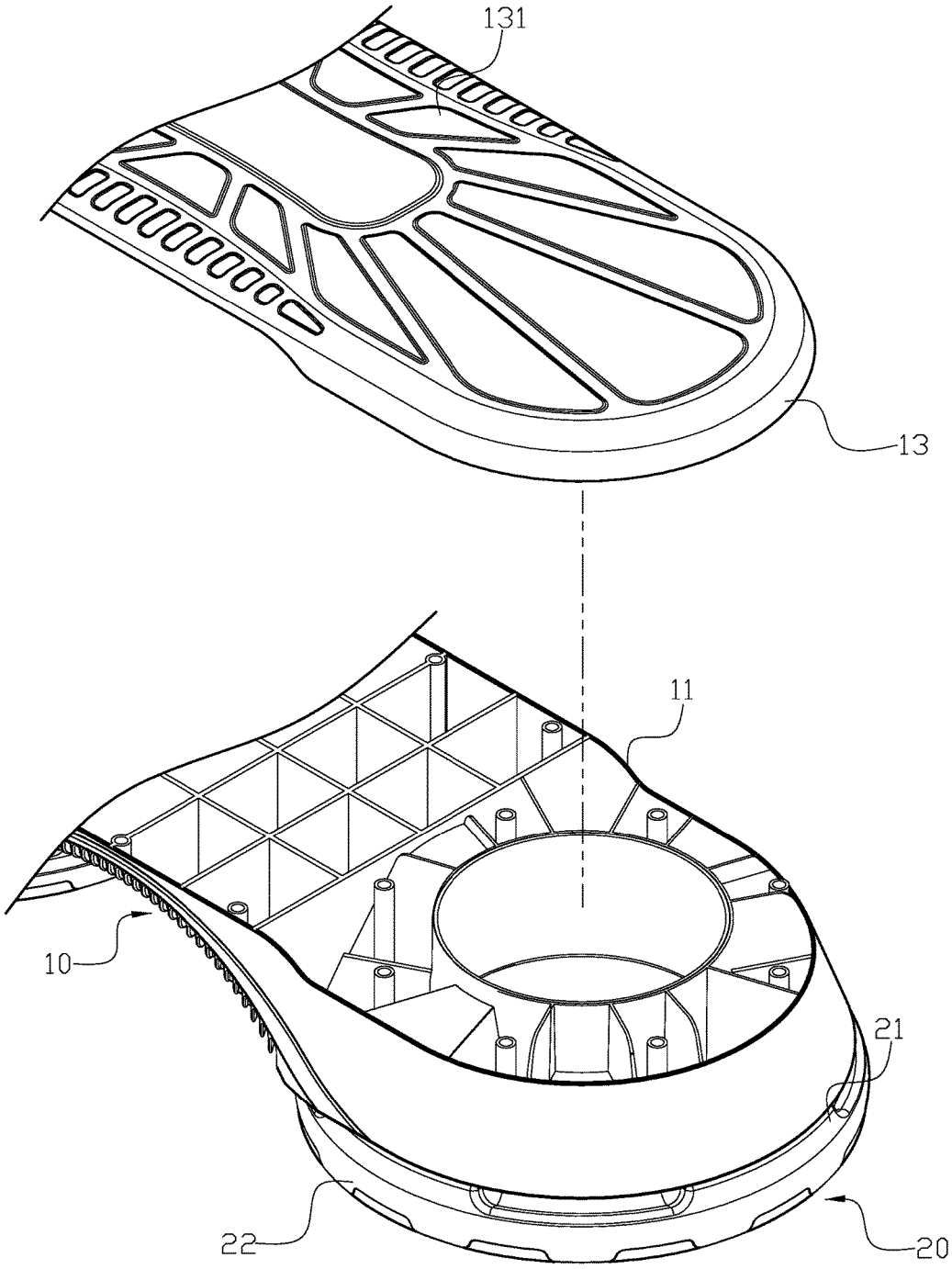
FIG. 2 is a partial exploded three dimensional view (1) of the present invention.
Figure 3:
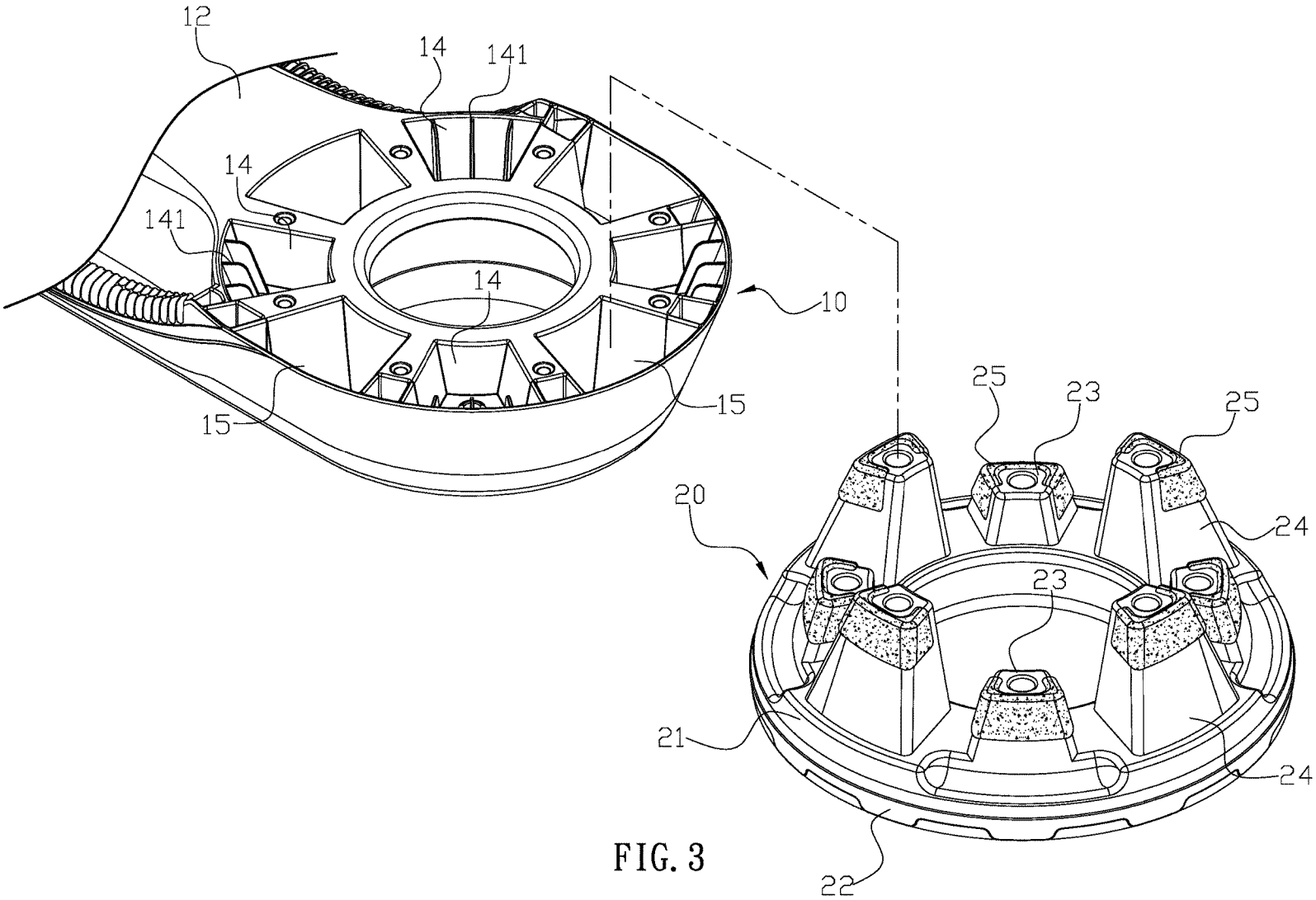
FIG. 3 is a partial exploded three dimensional view (2) of the present invention.
Figure 4:
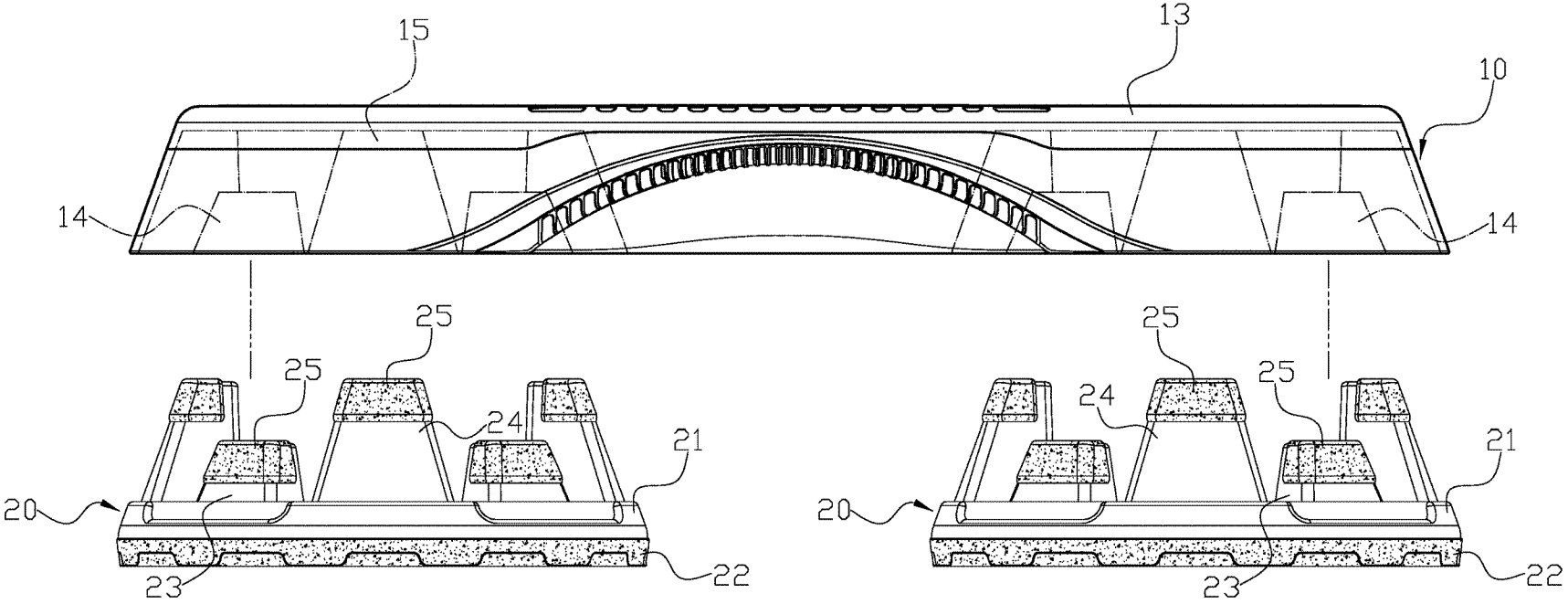
FIG. 4 is an exploded side view of the present invention having the first supporting blocks aligned to the fitting positions to the slots.
Figure 5:
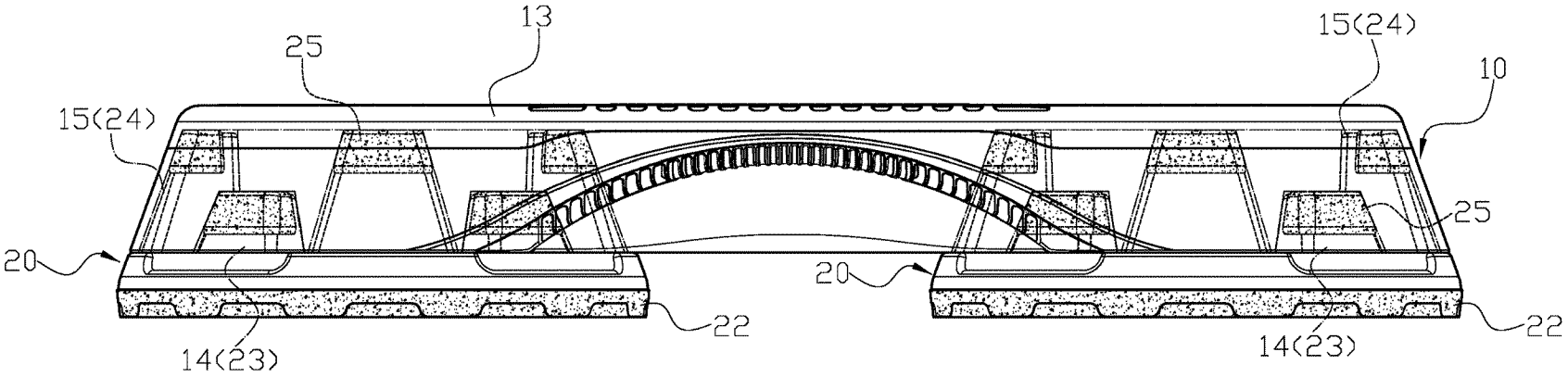
FIG. 5 is a transparent side view of the present invention after the first supporting blocks are fully assembled and plugged into the slots.

To better understand the objectives, novel features, contents and advantages of the present invention and the effect thereof that can be achieved, detailed descriptions accompanied by the Brief Description Of The Drawings of the present invention are provided as follows:

First, please refer to FIG. 1 to FIG. 3. The rhythm fitness step apparatus of the present invention includes a body 10 and two leg bases 20. The body 10 has an upper surface 11 and a lower surface 12, wherein the upper surface 11 is installed with a platform 13 thereon. The body 10 can be placed on the floor directly and, by means of the platform 13 on the upper surface 11, provide users to lift both legs and step on it alternately. In this mode of exercise, the body 10 is used as a step on platform of low level in height. Furthermore, both sides of the lower surface 12 of the body 10 are formed with an installation space separately. The installation space has a plurality of slots 14 and a plurality of dodge slots 15 concavely and alternately installed therein, wherein the concave depth of the slot 14 and the concave depth of the dodge slot 15 are different so that the depth of the dodge slot 15 is larger than the depth of the slot 14 in design. The leg base 20 has a plate body 21. The lower surface of the plate body 21 is installed with a cushion pad 22; the upper surface of the plate body 21 has a plurality of first supporting blocks 23 and a plurality of second supporting blocks 24 protruding therefrom alternately and corresponding to the configuration layout of the slots 14 and the dodge slots 15 of the body 10. The distance of the second supporting block 24 protruding from the upper surface of the plate body 21 is larger than that of the first supporting block 23 protruding from the upper surface of the plate body 21 so that the setting between every first supporting block 23 and every second supporting block 24 is in the form of a stair shape with a difference in height. By selecting supporting blocks of different protruding heights between the first supporting blocks 23 and the second supporting blocks 24 to be plugged into the slots 14 of the body 10, the body 10 of the rhythm fitness step apparatus can achieve different heights in structure, in terms of creating differences between the medium level of strength training and the high level of strength training. The outer upper edge of every first supporting block 23 and every second supporting block 24 has a soft pad 25 mounted thereon.

The present invention provides a rhythm fitness step apparatus, wherein the platform 13 is fixedly mounted on the upper surface 11 of the body 10 by means of the snap in type of fastening method with a detachable design for the convenience of customization of the platform 13.

The present invention provides a rhythm fitness step apparatus, wherein the platform 13 is covered with a non-slip pattern 131 on the surface thereof.

The present invention provides a rhythm fitness step apparatus, wherein the slot 14 and the first support block 23 fit together through a cone shape interface.

The resent invention provides a rhythm fitness step apparatus, wherein the slot 14 and the second support block 24 fit together through a cone shape interface.

The present invention provides a rhythm fitness step apparatus, wherein the slot 14 has a plurality of fins 141 installed inside to tightly hold against the first supporting block 23 or the second support block 24.

The present invention provides a rhythm fitness step apparatus, wherein the cushion pads 22 and the soft pads 25 are made of the rubber material.

The present invention provides a rhythm fitness step apparatus, wherein the cushion pads 22 and the soft pads 25 are made of the ABS material.

Figure 6:
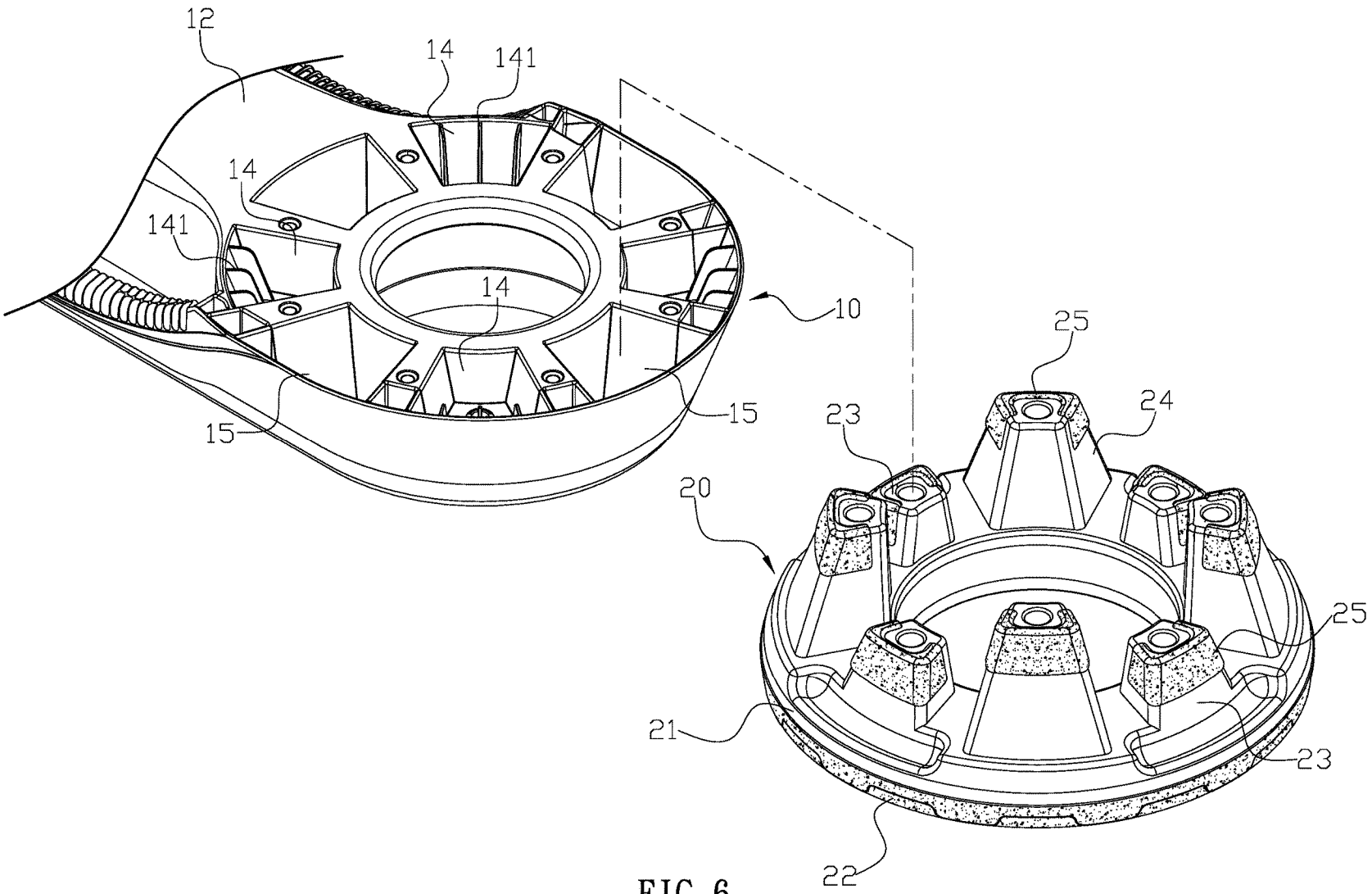
FIG. 6 is a partial exploded three dimensional view of the present invention having the second supporting blocks aligned to the fitting positions to the slots.
Figure 7:
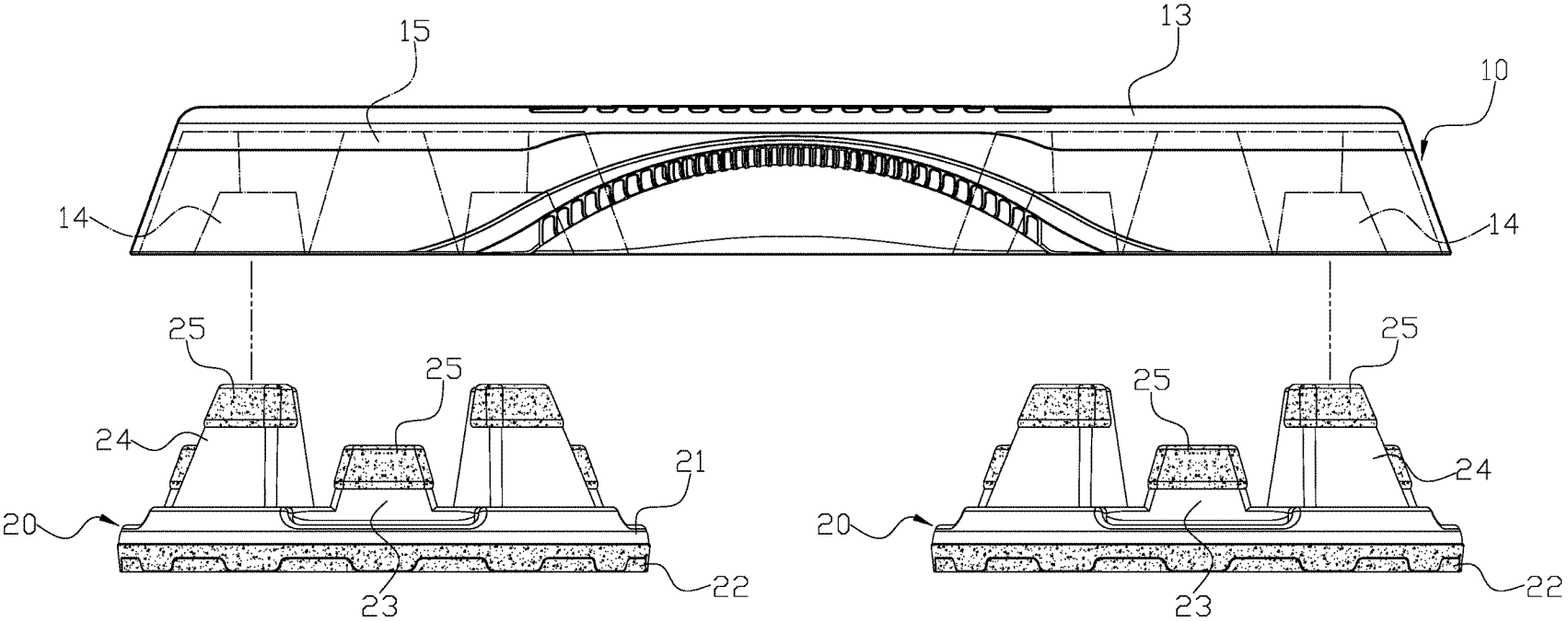
FIG. 7 is an exploded side view of the present invention having the second supporting blocks aligned to the fitting positions to the slots.
Figure 8:
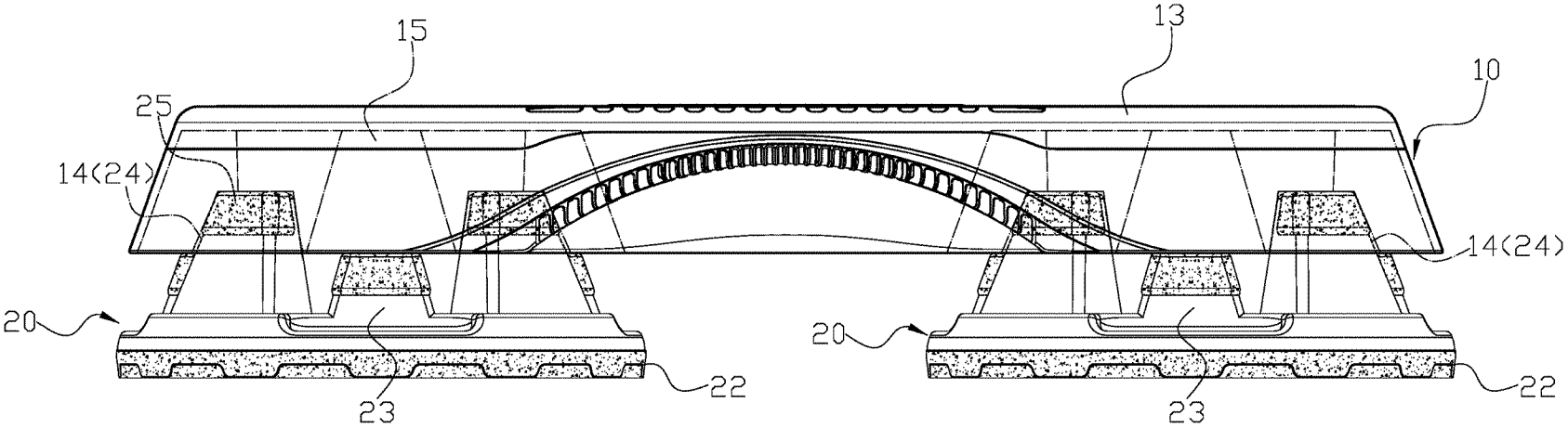
FIG. 8 is a transparent side view of the present invention after the second supporting blocks are fully assembled and plugged into the slots.

In practical use, the first supporting block 23 and the second supporting block 24 are plugged into the slot 14 and the dodge slot 15 of the body 10 respectively (please refer to FIG. 1 to FIG. 5 together). Therefore, the body 10 is positioned higher by the first supporting block 23, resulting in the platform 13 to change in height from the floor, so that the user can receive a medium level of strength training. On the other hand, when the second supporting block 24 is plugged into the slot 14 of the body 10 instead (please refer to FIG. 6 to FIG. 8 together), the body 10 is positioned even higher by the second supporting block 24, so that the user can receive a high level of strength training.

In summary, the advantages of the a rhythm fitness step apparatus of the present invention are as follows: (1) The rhythm fitness step apparatus has a suitable size and a simple structure and, therefore, is feasible for regular households to purchase for achieving the effect of exercise within an indoor space; (2) The rhythm fitness step apparatus can be used for exercise for different parts of the user's body. Furthermore, the methods of fitness exercise of the present invention are not limited to simple movements of the low level of strength training. Instead, the present invention provides methods of fitness exercise involving movements of the basic level to the advanced level and rhythmic to aerobic exercises. Therefore, the rhythm fitness step apparatus of the present invention increases the practicality significantly and avoids the same repeated exercise method that may cause users to feel bored and dull; (3) The rhythm fitness step apparatus is designed to separate the leg base 20 and the floor, as well as the body 10 and the leg base 20, by using the cushion pads 22 and soft pads 25. Therefore, the design of the present invention can prevent the direct impact between hard objects that generates irritating noise. Using the cushion pads 22 and soft pads 25 to reduce the vibration during exercise can also effectively prolong the service life of the rhythm fitness step apparatus and better prevent sports injuries from happening.

However, the aforementioned embodiments are chosen and described in order to explain the technological concepts and characteristics of the present invention and are not intended to limit the scope of the present invention in any way. Alternative embodiments will become apparent to those skilled in the art to which the present invention pertains without departing from its spirit and scope.

What is claimed is:

1. A rhythm fitness step apparatus comprising:

a body; and two leg bases, wherein:

the body has an upper surface and a lower surface, the upper surface including a platform thereon and the body configured to be placed directly on a floor, the platform on the upper surface configured to allow a user to step on the platform alternately so that the body is used as a step of low level in height for the platform;

both sides of the lower surface of the body comprise a respective installation space, wherein each installation space has a plurality of first slots and a plurality of second slots concavely and alternatingly installed therein, a concave depth of the first slots being different from a concave depth of the second slots so that a depth of the second slots is greater than a depth of the first slots;

the leg bases have a plate body, a lower surface of the plate body including a cushion pad, an upper surface of the plate body having a plurality of first supporting blocks and a plurality of second supporting blocks protruding alternatingly therefrom and corresponding to a configuration layout of the first slots and the second slots of the body, a distance of each second supporting block protruding from the upper surface of the plate body being greater than that of each first supporting block protruding from the upper surface of the plate body so that a configuration between every first supporting block and every second supporting block is in the form of a stair shape with a difference in height;

wherein by selecting supporting blocks of different protruding heights between the first supporting blocks and the second supporting blocks to be plugged into the first and second slots of the body, the body of the rhythm fitness step apparatus achieves different heights, thereby providing differences between a medium level of strength training and a high level of strength training, an outer upper edge of each first supporting block and each second supporting block having a resilient pad mounted thereon.

2. The rhythm fitness step apparatus as claimed in claim 1, wherein the platform is fixedly mounted on the upper surface of the body by means of a detachable snap fastener.

3. The rhythm fitness step apparatus as claimed in claim 1, wherein the platform is covered with a non-slip pattern on a surface thereof.

4. The rhythm fitness step apparatus as claimed in claim 1, wherein the first slots and the first support blocks fit together through a tapered interface.

5. The rhythm fitness step apparatus as claimed in claim 1, wherein the first slots and the second support blocks fit together through a tapered interface.

6. The rhythm fitness step apparatus as claimed in claim 1, wherein each first slot has a plurality of fins internally installed to hold against the first supporting blocks or the second support blocks.

7. The rhythm fitness step apparatus as claimed in claim 1, wherein the cushion pads and the resilient pads are made of a rubber material.

8. The rhythm fitness step apparatus as claimed in claim 1, wherein the cushion pads and the resilient pads are made of an ABS material.

* * * * *